US008118517B2

(12) United States Patent
Kelley et al.

(10) Patent No.: US 8,118,517 B2
(45) Date of Patent: Feb. 21, 2012

(54) MANHOLE COVER DEVICE

(76) Inventors: John Kelley, Murray, UT (US); David Elder, Centerville, UT (US)

( * ) Notice: Subject to any disclaimer, the term of this patent is extended or adjusted under 35 U.S.C. 154(b) by 30 days.

(21) Appl. No.: 12/721,351

(22) Filed: Mar. 10, 2010

(65) Prior Publication Data

US 2011/0222963 A1 Sep. 15, 2011

(51) Int. Cl.
*E02D 29/14* (2006.01)

(52) U.S. Cl. ..... 404/25; 52/19; 49/49

(58) Field of Classification Search ..... 404/12–16, 404/25, 26; 52/19, 20; 49/49
See application file for complete search history.

(56) References Cited

U.S. PATENT DOCUMENTS

| | | | | |
|---|---|---|---|---|
| 4,995,757 | A | 2/1991 | Prescott | |
| 5,078,539 | A | 1/1992 | Claing | |
| RE34,550 | E * | 2/1994 | Bowman | 404/26 |
| 5,470,172 | A | 11/1995 | Wiedrich | |
| 5,529,431 | A | 6/1996 | Walsh | |
| 5,564,855 | A | 10/1996 | Anderson | |
| 5,797,221 | A | 8/1998 | Young et al. | |
| 5,956,905 | A | 9/1999 | Wiedrich | |
| 6,435,764 | B1 | 8/2002 | McNeely | |
| 6,457,901 | B1 | 10/2002 | Sondrup | |
| 6,520,713 | B2 | 2/2003 | Sondrup | |
| 6,524,026 | B2 | 2/2003 | Sondrup | |
| 6,695,526 | B2 | 2/2004 | Sondrup | |
| 6,769,834 | B1 | 8/2004 | Stange | |
| 6,851,225 | B1 | 2/2005 | Haar et al. | |
| 6,994,489 | B1 * | 2/2006 | Corr | 404/25 |
| 7,303,354 | B1 | 12/2007 | DeCroix | |
| 2002/0098038 | A1 * | 7/2002 | Hassler | 404/26 |
| 2002/0176743 | A1 * | 11/2002 | Shumlansky et al. | 404/26 |
| 2008/0168719 | A1 * | 7/2008 | Borunda | 52/20 |
| 2009/0297265 | A1 * | 12/2009 | Wood | 404/26 |

* cited by examiner

*Primary Examiner* — Raymond Addie
(74) *Attorney, Agent, or Firm* — Webb IP Law Group; Jason P. Webb; Danny Y. H. Cheng

(57) ABSTRACT

A rubber manhole cover, suitable for attaching to a top of a metal manhole lid, includes at least two bonded layers of rubber material of differing properties, including a bottom layer of a first rubber material, and a top layer of vulcanized rubber material, the top and bottom layers functioning as a single unit.

20 Claims, 4 Drawing Sheets

MANHOLE COVER DEVICE

BACKGROUND

1. Field of the Invention

The present invention relates generally to manhole covers. More particularly, the present invention relates to a resilient pad that is attachable to a manhole cover.

2. Related Art

Manholes are common structures in streets and roadways for allowing access to underground utilities such as water and sewer lines or stored materials or equipment. Manholes provide an opening to allow workmen to descend beneath the surface to obtain access to these underground items. Manholes and manhole covers are typically subject to significant loads, such as the weight of roadway vehicles and impact loads from them, and thus must be made of strong and durable materials. The top of a manhole typically includes a strong metal (e.g. cast iron) frame having a projecting ledge around the circumference of the opening, with a heavy cast iron cover that rests on the ledge and closes the manhole. The cover is designed to support surface loads, and the frame transmits those loads to the underground supporting structure. Manhole covers are generally made heavy to resist unintentional opening or vandalism, and in many cases are bolted down in order to make the installation water tight and tamper-proof.

One challenge associated with manhole installations is maintaining the manhole cover flush with a surrounding roadway elevation. When a street is repaved, the pavement elevation increases by a few inches. Manholes can also settle over time, producing an elevation difference with surrounding pavement. If these conditions are not corrected, the manhole location can present a road hazard, the manhole cover and supporting structure will be subjected to increased impact loads from passing vehicles, and the surrounding pavement is likely to degrade more quickly. To avoid these problems, road paving crews sometimes simply pave over an existing manhole. Unfortunately, this defeats the whole purpose of the manhole, and hides its location from view.

More commonly, when a street is repaved or a manhole has settled, existing manholes in the street are typically raised to match the elevation of the pavement. This process typically involves the installation of new grade rings or other structures atop the manhole frame to raise its elevation, and may also involve the installation of a new concrete collar surrounding the manhole to reinforce the transition from asphalt pavement to the rigid cast iron manhole top. Unfortunately, raising manholes in a street can be an expensive and time-consuming process, thus adding to the financial burden that highway maintenance agencies face in building and maintaining roadways.

SUMMARY

It has been recognized that it would be advantageous to develop a system for raising manhole elevations that is simple and inexpensive.

It has also been recognized that it would be advantageous to have a manhole grade adjustment system that makes manhole covers more useful.

In accordance with one embodiment thereof, the present invention provides a manhole cover device that includes a bottom layer of rubber material, suitable for attaching to a top of a metal manhole lid, having a top surface, and a first top layer of vulcanized rubber material, having different material properties than the bottom layer. The top layer is affixed to the top surface of the bottom layer, the top and bottom layers functioning as a single unit.

In accordance with another embodiment thereof, the invention provides a manhole cover device for attachment to a metal manhole lid, including a manhole lid of metal, disposed below an elevation of surrounding pavement, and a cover, attached atop the manhole lid. The cover includes at least two bonded layers of rubber material of differing properties, and has an overall thickness sufficient to substantially match the elevation of the surrounding pavement.

In accordance with yet another embodiment thereof, the invention provides a rubber manhole cover, suitable for attaching to a top of a metal manhole lid. The rubber manhole cover includes at least two bonded layers of rubber material of differing properties, including a bottom layer of a first rubber material, and a top layer of vulcanized rubber material, the top and bottom layers functioning as a single unit.

BRIEF DESCRIPTION OF THE DRAWINGS

Additional features and advantages of the invention will be apparent from the detailed description which follows, taken in conjunction with the accompanying drawings, which together illustrate, by way of example, features of the invention, and wherein.

DETAILED DESCRIPTION

Figure 1:
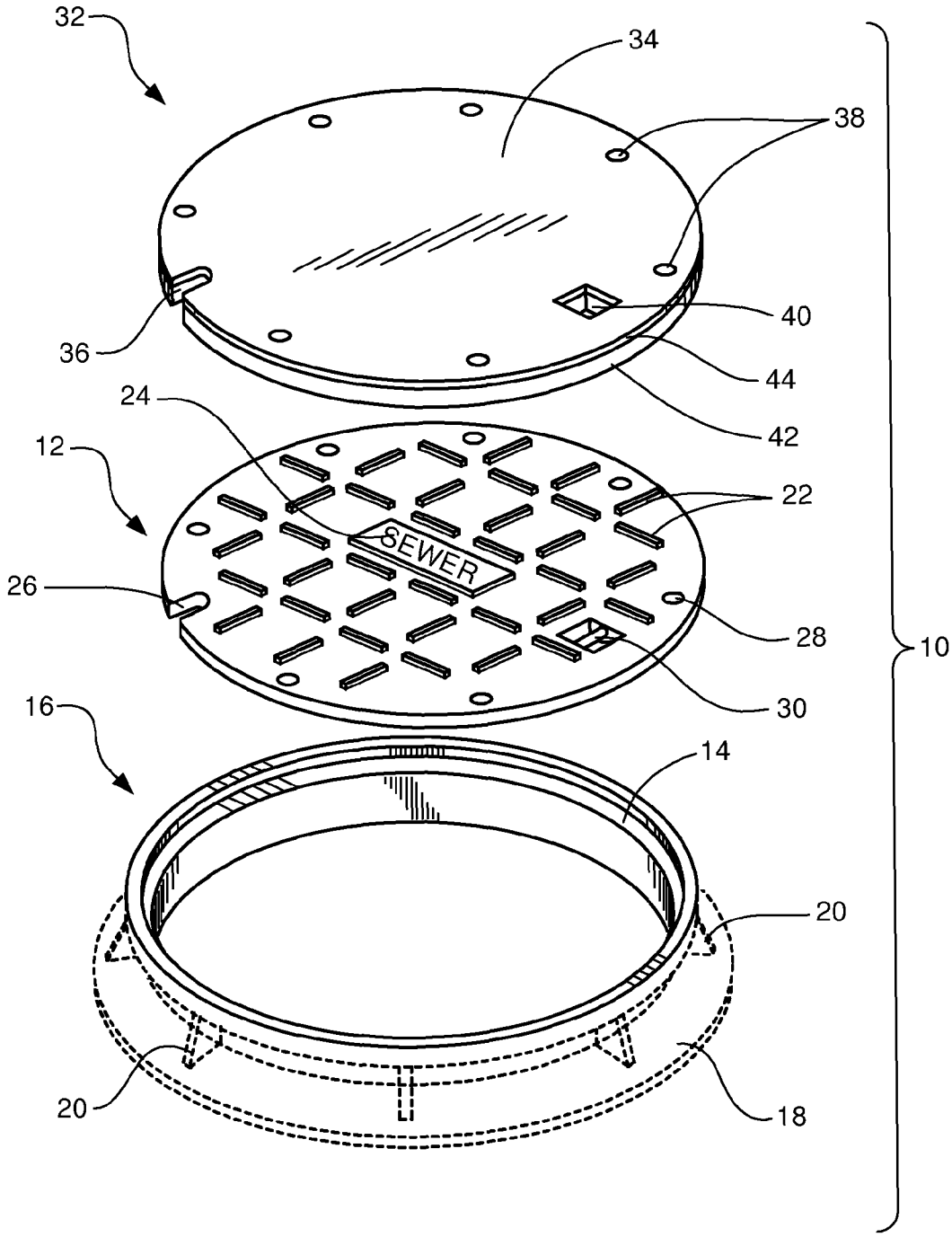
FIG. 1 is an exploded perspective view of a manhole cover assembly and an embodiment of a manhole cover device in accordance with the present disclosure.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As noted above, the relative elevation between a manhole cover and surrounding pavement can change due to settlement of a manhole or repaving of a street. In some cases manhole covers are simply paved over when a road is resurfaced. This is not only annoying for drivers and damaging to pavement, but it also hinders access to the manhole. Workers must chip away the pavement before opening the manhole cover, leaving a pothole in the surface. For these and other reasons there is often a need to raise existing manholes to match the elevation of the surrounding pavement. This ordinarily involves some digging in the road to install new manhole rings or other relatively expensive devices to bring the manhole cover up to the new grade level.

Advantageously, the inventors have developed a simple and relatively inexpensive system for adjusting the grade of existing manholes. Shown in FIG. 1 is an exploded view of one embodiment of a manhole cover system 10 in accordance with the present invention. As is well known, conventional manholes typically include a manhole lid 12 that is configured to be supported in the rim 14 of a manhole ring or frame 16. The frame and manhole lid are typically of strong and durable metal, such as grey cast iron. The frame 16 is configured to rest atop a manhole substructure (not shown in FIG. 1), which can be of pre-cast concrete, and typically includes a cone section at its top. The frame sits atop the cone section, or on one or more ring sections that are atop the cone section. The manhole frame also frequently includes a horizontal flange 18, which extends outward, allowing compacted road base, pavement, concrete, or other material placed around the manhole rim to hold the rim in place. The frame can also include gussets 20 which extend between the vertical wall of the frame and the flange, for added strength, and to further help anchor the frame in surrounding material.

Typical manhole lids, like the manhole lid 12 shown in FIG. 1, often include ridges or lugs 22 or other protrusions cast into their top surface to increase the physical roughness of the surface and thereby provide additional traction for vehicles that ride over the cover. Manhole lids also frequently include words or other indicia 24 cast into their top surface. The manhole lid can also include openings that pass through its top surface, such as an opening 26 at the edge of the lid, and holes 28 or other openings in any area of the lid. The edge opening 26 or holes 28 can be used to allow a lifting tool to be inserted for opening the manhole. The holes 28 can also be used for bolts to secure the lid in place. The manhole lid can also include a recessed lifting bar 30 that is cast into its top surface, for insertion of a lifting tool for opening the manhole. It is to be understood that the openings and features of the manhole lid 12 shown in FIG. 1 are exemplary only. The number and types of openings and features in the manhole lid can vary widely.

In order to allow the manhole cover to be adjusted to grade easily, the present invention provides a manhole cover device 32. The manhole cover device is a durable cover or pad, indicated generally at 34, that attaches to the top of the cast iron manhole lid to approximately match the level of the surrounding pavement. Cross-sectional views of various manhole structures having manhole lids provided with various embodiments of a manhole pad or cover in accordance with the present disclosure are provided in FIGS. 2-3. In these figures the manhole frame 16 and its parts are shown, as is the top of an underlying manhole structure 17.

Figure 2:
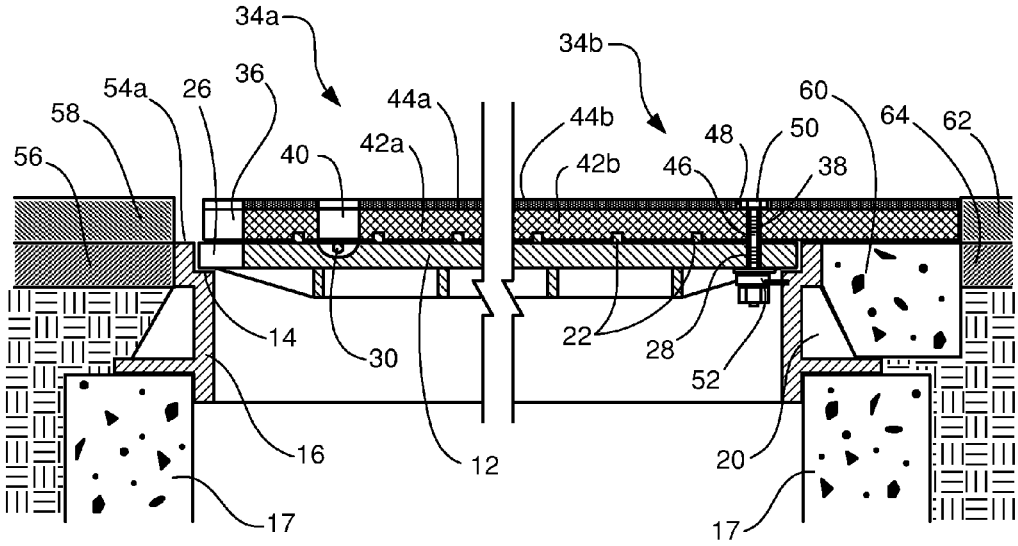
FIG. 2 is a side, cross-sectional view of a manhole cover assembly and an embodiment of a manhole cover device in accordance with the present disclosure.

As shown in FIGS. 1 and 2, the pad 34 can include apertures or openings that allow access to the manhole lid below. For example, the pad can have an elongate aperture 36 at an edge to allow access to the edge opening 26 of the manhole lid. It can also have holes 38 in its body to allow access to corresponding holes 28 in the metal manhole lid 12. It can also have a rectangular opening 40 that allows access to the recessed lifting bar 30 of the manhole lid.

The manhole pad or cover 34 includes at least two layers of resilient material, such as rubber, or rubber-like material. The pad has a bottom layer 42 of one type of material, and at least one top layer 44 of a different type of material. The top and bottom layers can be affixed together with chemical adhesive, such as industrial strength sag resistant adhesive, rubber-to-rubber adhesive, fasteners, such as large staples, or cement type adhesives. The bottom layer can be of a relatively soft rubber material, and the top layer can be of a harder and/or more durable material. This multi-ply configuration provides several advantageous features. The bottom layer can be of recycled rubber, which is relatively inexpensive. Other materials, such as neoprene, can also be used. The bottom layer can be soft enough to deform around the lugs 22, protrusions, indicia 24, and other irregularities in the manhole lid 12. The bottom layer can be made out of recycled rubber. The bottom layer can have a durometer of about 60+/−5 Shore A, hardness of 60 lb/ft, compression recovery of about 98%, and tensile strength of about 300 psi. Other materials that can be used include various rubber combinations, such as butyl rubber, chlorobutyl, epichlorhydrin, ethylene propylene rubber, hydrogenated nitrile rubber, natural rubber, nitrile rubber, polychloroprene, polyurethane rubber, and styrene butadiene rubber.

The top layer 44, on the other hand, can be of a vulcanized rubber material that is more durable under the wear and tear of roadway traffic. In one embodiment, the top layer is neoprene (polychloroprene) rubber. In another embodiment, the top layer can be a blend of SBR (styrene butadiene rubber), CR (neoprene) and NBR (nitrile) rubbers, which gives it a 55-65 durometer, minimum tensile strength of 725 psi, temperature range of −40° to 200° F. Resistance to UV radiation is also desirable for the top layer. Accordingly, materials can be selected that have a high EPDM, making the top layer UV resistant. Other rubbers which can be used include butyl rubber, chlorobutyl, epichlorhydrin, ethylene propylene rubber, hydrogenated nitrile rubber, natural rubber, nitrile rubber, polychloroprene, polyurethane rubber, and styrene butadiene rubber. More durable vulcanized rubber materials tend to resist deformation around deformities beneath them, but are durable against wear and the elements, and provide a non-skid surface. Recycled rubber materials, on the other hand, more readily conform to, even grind into irregularities, but are less durable and resistant to the elements. Using these two types of layers together allows the bottom layer to smooth out the irregularities, and provide a smooth durable top surface.

Having two layers also helps resist curling or warping of the pad 34. Single ply vulcanized rubber pieces have a tendency to curl at the edges, due to internal stresses created during the vulcanization process. A manhole cover that curls at the edges is not only unsightly, but can present a road hazard, and can wear out faster than one that is flat. Additionally, pads that are curled up at the edges can be pulled up or torn up by a snowplow or the like, and can be prone to vandalism. The multi-ply configuration disclosed herein reduces curling and warping by adhering the curl-prone vulcanized top layer 44 to a bottom layer 42 of material that is not as prone to warping. The bottom layer thus helps resist the tendencies of the top layer, and keeps the whole assembly more flat.

The relative thicknesses of the top and bottom layers 44, 42, can vary. As shown on the left side in FIG. 2, the bottom layer 42*a* can be significantly thicker than the top layer 44*a*. This can reduce the overall weight of the pad 34 (since the bottom layer can be less dense than the top layer) and also provide more dimensional stabilization (e.g. warp resistance) to the top layer. Different thickness ratios can also be used. For example, as shown on the left side of FIG. 3, the bottom layer 42*a* can be of a similar thickness to the top layer 44*a*. In general, the inventors have found that a bottom layer of from about ¼ to 2.5 inches thick and a top layer that is about ¼ to ½ inch thick is useful. More generally, the bottom layer can be from ¼ to 7 inches thick, and the top layer can be from ¼ to 5 inches thick.

More than two layers can also be provided, and these can be in various configurations and thickness combinations. For example, shown on the right side of FIG. 3, a pad 34*d* comprises a bottom layer 42 and three top layers 44*d, e, f*. The top layers can be of the same or similar thickness, or can be different thicknesses. It should be understood, that multiple layers of differing thicknesses can be affixed together to produce a desired overall thickness of the top layer 44 and of the pad 34 as a whole.

The manhole pad or cover 34 can be attached to the manhole lid 12 using mechanical fasteners or chemical adhesive. For example, shown on the left side of FIG. 2, the manhole cover pad 34*a* is attached using a chemical adhesive, without mechanical fasteners. Suitable adhesives for attaching a rubber manhole cover to a metal manhole lid include chemical adhesive, such as industrial strength sag resistant adhesive, any rubber-to-metal adhesive, or cement adhesives of various types. However, on the right side of FIG. 2, a part of an embodiment of a manhole cover 34*b* is shown having a bolt 46 extending through an aperture 28 in the lid and a corresponding aperture 38 in the pad 34. This bolt is representative of any type of mechanical fastener. Bolts, staples, or other mechanical fasteners can be used. The aperture in the pad can include a recessed top portion 48, so that the head 50 of the bolt will lie below the top surface of the top pad 44*b*. Fasteners that hold down the pad 34 can also be used to fasten the lid 12 in place, as shown on the right side of FIG. 2, where the bolt attaches to a lid latch device 52 that holds the lid to the manhole frame 16.

The manhole cover 34 can be of different shapes and sizes, and can be used in a variety of installation conditions. The manhole pad shown in FIG. 1 is circular, and this may be the most common shape for most manhole installations. However, the pad is not limited to a circular shape. Manhole covers of various shapes can be used for different applications, whether circular, square, rectangular, or any other desired shape.

The size of the manhole cover can also vary. For example, shown on the left side of FIG. 2, the manhole cover 34*a* substantially completely covers the manhole lid 12, but does not extend over the rim edge 54*a* of the manhole frame 16. This view depicts a situation where a manhole frame is surrounded by a first layer of pavement 56, and the rim of the frame is flush with this pavement. However, a subsequent layer of pavement 58 has been placed on top of the first layer, raising the elevation of the pavement. In this situation a manhole cover pad 34*a* of a similar overall thickness as the new layer of pavement is attached to the top of the manhole lid 12, thus substantially matching the elevation of the new pavement. In this embodiment there is a small gap between the pad 34 and the new pavement, directly above over the rim edge 54*a* of the manhole frame.

In another embodiment, shown on the right side of FIG. 2, the manhole pad 34*b* extends out to the edge of a concrete collar 60 that surrounds the manhole frame 16 and extends to the edge of a first layer 62 of pavement. Such collars are a common feature and are typically cast in place around manhole frames after a paving operation. These collars provide a transition between the metal manhole frame and the edge of asphalt pavement, providing a more durable installation. In the embodiment shown on the right side of FIG. 2, a new layer of pavement 64 has been placed atop the first layer 62. This new layer is placed up to the beginning of the concrete collar. Rather than removing and replacing the concrete collar 60, which is relatively expensive and time-consuming, the resilient pad 34 extends over the collar to meet the new pavement edge, matching the elevation of the new pavement.

Figure 3:
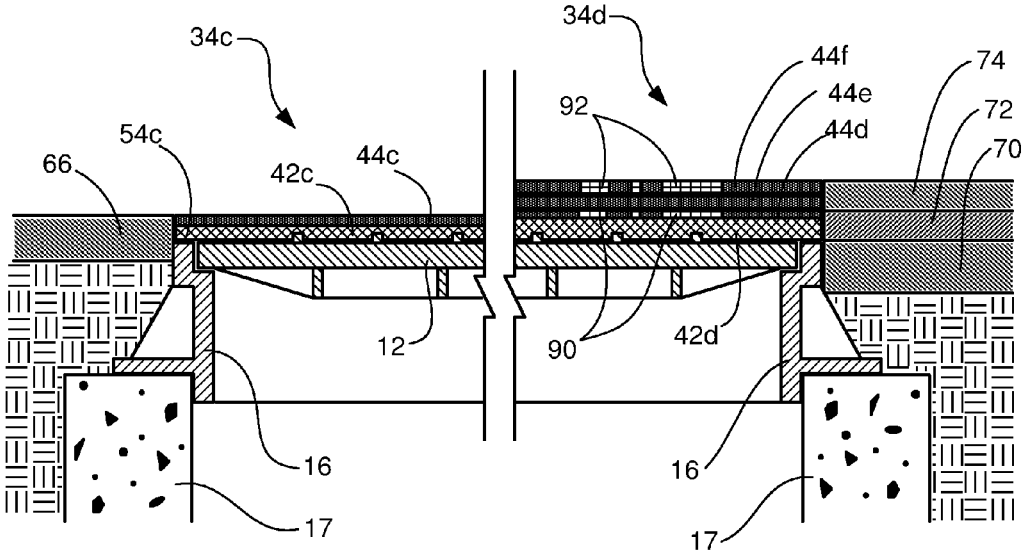
FIG. 3 is a side, cross-sectional view of a manhole cover assembly and another embodiment of a manhole cover device in accordance with the present disclosure.

The configuration shown on the left side of FIG. 3 represents a settled manhole situation. Here the manhole frame 16 has settled or dropped some amount relative to the adjacent pavement 66. In this situation, a manhole cover or pad 34*c* is placed atop the manhole lid 12 to bring the level up to match the existing pavement. In this case, unlike that on the left side of FIG. 2, the pad extends over the rim edge 54*c* of the manhole frame, leaving substantially no gap between the pad and the pavement.

Shown on the right side of FIG. 3 is another situation where a roadway surface has been repaved multiple times. In this configuration, the first layer of pavement 70 substantially matched the elevation of the rim edge 54*d* of the manhole frame. When a second layer of pavement 72 was placed, a first pad 34*d* having a bottom layer 42*d* and a top layer 44*d* was attached to the manhole lid 12 to match the elevation of the new pavement. Then, when a subsequent new layer of pavement 74 was placed, two additional top layers 44*e* and 44*f* were added to the top of the first pad 34*d*. This embodiment demonstrates how new layers can be added to an existing manhole cover when a pavement elevation changes. Alternatively, when a pavement elevation changes around an existing pad 34, the existing pad can be removed and a new pad having a desired total thickness can be placed back on the manhole lid.

The manhole pad or cover 34 can be provided in a number of other variations, too. For example, rather than being intended to deform around irregularities in the top surface of a manhole lid (e.g. lugs 22 in FIGS. 1 & 2), the bottom layer can be made with indentations preformed in its bottom surface, so as to conform to the shape of the manhole lid. One possible way to do this is to press the bottom layer 42 against the respective manhole lid or a mold having a comparable shape, so that the bottom layer becomes molded to conform to the lid.

Figure 4:
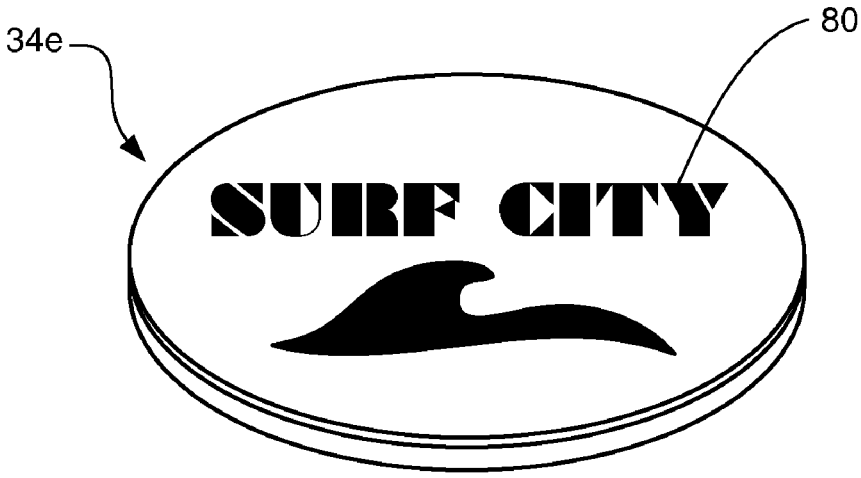
FIG. 4 is a perspective view of an embodiment of a manhole cover device in accordance with the present disclosure, having indicia disposed upon the top layer.
Figure 5:
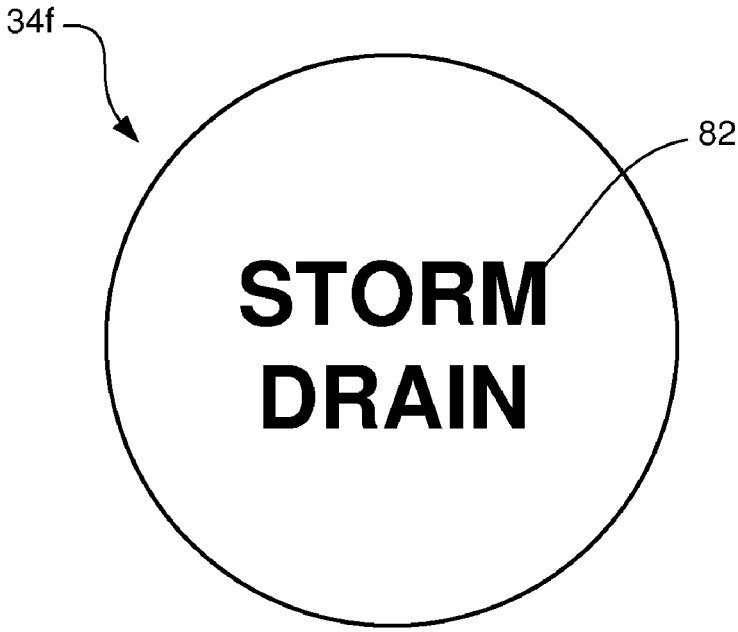
FIGS. 5-7 are top views of three embodiments of manhole cover devices in accordance with the present disclosure, having different types of indicia associated with the top surface.

Another feature that is provided by the manhole cover disclosed herein is that the pads 34 provide a location for useful or desirable indicia. The manhole covers or pads disclosed herein can have alphanumeric characters, linguistic characters, ornamental designs, marks, logos, visual targets, or any other type of indicia provide on their top surface. For example, shown in FIG. 4 is a perspective view of a manhole cover pad 34 having a decorative logo 80, comprising words and design elements. As in this figure, the indicia can identify a location, a city, an owner of infrastructure facilities, maker of products, or it can serve as advertising or any other type of indicia. Shown in FIG. 5 is another embodiment of a pad 34*f* in which the indicia 82 comprise words that identify the function or type of the installation. This sort of indicia can be helpful for public utility identification and maintenance. For example, a city public works department or public utility can use specially-designed manhole cover pads that identify and distinguish the manhole covers that are of interest to the particular company or department. These could include words, as shown in FIG. 5, or they could use more abstract identification numbers, letters, etc.

Figure 6:
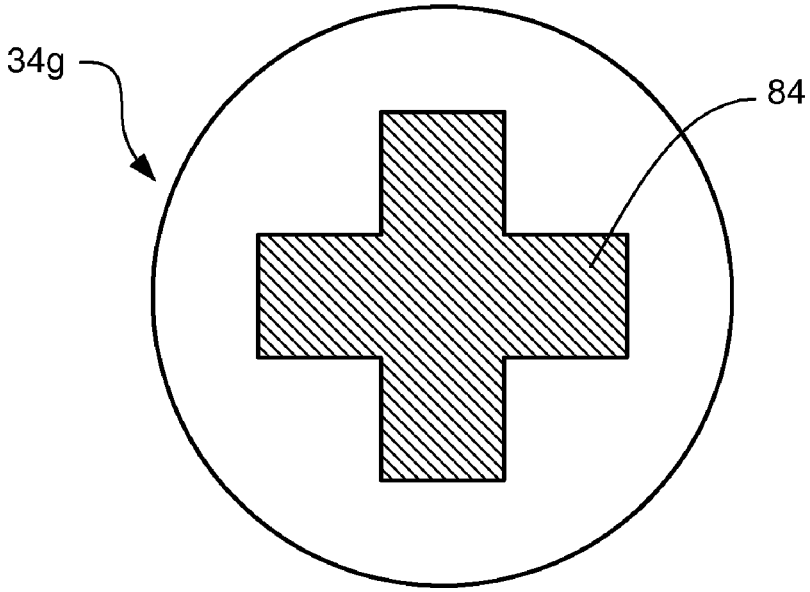
Figure 7:
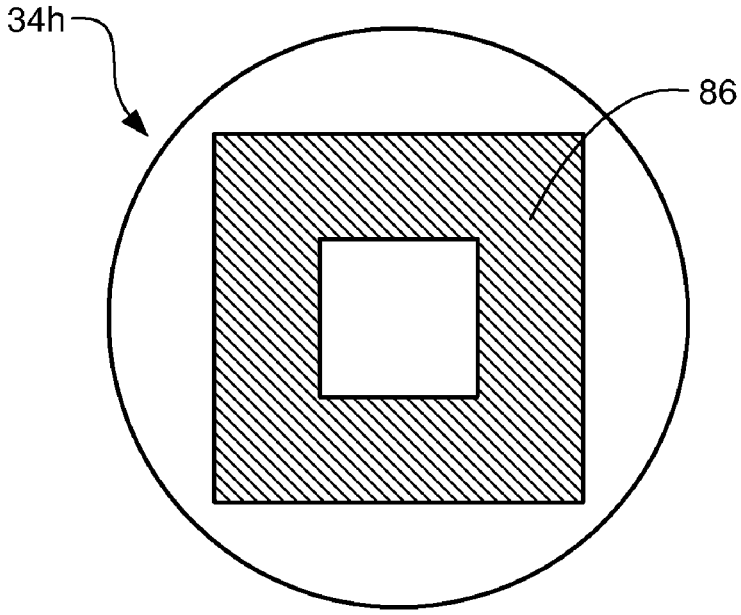

Other examples of indicia are shown in FIGS. 6-7. These indicia provide targets or geometric shapes, such as a cross 84 in the cover 34*g* in FIG. 7, and a square 84 in the cover 34*h*, shown in FIG. 8. These sorts of large shapes or targets can be used to help make the location of the manhole easily visible from far away, such as for aerial photography and aerial surveying. These targets can use highly contrasting colors and different target shapes corresponding to different types of manholes (e.g. storm drain vs. sanitary sewer, etc.). Such high visibility indicia can be useful for creating and maintaining global information systems (GIS) by municipalities and other entities.

The method for applying indicia to the manhole cover pad can vary. It will be apparent that paints or pigments can be used. Advantageously, the configuration of the manhole cover pad 34 disclosed herein lends itself to a more durable method for providing desired indicia by providing rubber inlays of contrasting color to produce words, letters, logos, etc. The top layer 44 of rubber material can be cut and material removed to create cutouts of any desired shape inside the boundary of the manhole cover. Corresponding pieces of the exact size and shape of the cutouts can be cut from other pieces of rubber having the same thickness and a contrasting color. Highly accurate cutting of the cutouts and the inlay pieces can be done using water jet cutters and other cutting devices that are well known and widely available. The inlay pieces can then be inlaid into the cutouts in the manhole cover pad, and the cover with the contrasting color inlay pieces can then be vulcanized as a unit, fusing the inlays and surrounding material into an integral unit. This method provides the desired indicia as integrally vulcanized color inlays in a single manhole cover pad. The indicia will be highly durable because they are integral with the material of the top layer of the cover, and will provide the desired shape and color over the life of the manhole cover, even as the top surface wears.

Cross-sectional views of top layers 44 having inlaid pieces are shown in FIG. 3. On the right side of FIG. 3, it can be seen that the top layer 44*d* includes several inlaid pieces 90, which can be part of a desired indicia. The inlaid pieces comprise integral parts of the top layer, but are of a contrasting color. Then, when new top layers were placed to match a new pavement elevation, the same (or a different) indicia is provided in the new topmost layer 44*f* using inlaid pieces 92 in the same manner. In this way, a top surface of the manhole cover can always be provided with the desired indicia in a durable, highly visible format. Multiple inlay pieces can be used in any desired color or combination of colors to provide a durable, aesthetically pleasing manner.

This manhole cover disclosed herein thus provides a durable, non-skid surface, and eliminates the need for more expensive grade rings or other devices to bring a manhole lid up to grade. The manhole cover can be attached to a manhole lid using mechanical fasteners or adhesive, and comprises multiple layers, thus helping it remain geometrically stable while also being economical and easily conformable to the shape of the top of the underlying manhole lid. Decorative and/or functional indicia can be provided on the top surface of the manhole cover, such as with rubber inlays, thus giving the pad an additional function in a durable configuration.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A manhole cover device, comprising:

a bottom layer of rubber material, suitable for attaching to a top of a metal manhole lid, having a top surface; and a first top layer of vulcanized rubber material, having different material properties than the bottom layer, the top layer being affixed to the top surface of the bottom layer, the top and bottom layers functioning as a single unit.

2. A manhole cover device in accordance with claim 1, wherein the bottom layer is of recycled rubber material having a durometer of about 55-65, and the top layer is of Neoprene rubber, having a durometer of about 55-65.

3. A manhole cover device in accordance with claim 1, wherein the bottom layer has a thickness of from about ¼ to about 2½ inches, and the top layer has a thickness of from about ¼ to ½ inches.

4. A manhole cover device in accordance with claim 1, wherein the bottom and top layers are affixed via one of sag resistant adhesive, rubber-to-rubber adhesive, mechanical fasteners, and cement-type adhesives.

5. A manhole cover device in accordance with claim 1, further comprising an aperture, defined by sidewalls, extending through the top and bottom layers, for providing access to a portion of the manhole lid below.

6. A manhole cover device in accordance with claim 1, wherein the bottom layer is attachable to the top of the manhole lid by one of the mechanical fasteners and chemical adhesive.

7. A manhole cover device in accordance with claim 1, further comprising a second top layer of vulcanized rubber material, having a top surface, affixed to the top surface of the first top layer.

8. A manhole cover device in accordance with claim 1, further comprising indicia, associated with the top surface of the top layer.

9. A manhole cover device in accordance with claim 8, wherein the indicia comprise integral rubber inlays of contrasting appearance in the top layer.

10. A manhole cover device in accordance with claim 8, wherein the indicia are selected from the group consisting of alphanumeric characters, linguistic characters, ornamental designs, marks, logos and visual targets.

11. A manhole cover system, comprising:

a manhole lid of metal, disposed below an elevation of surrounding pavement; and a cover, attached atop the manhole lid, comprising at least two bonded layers of rubber material of differing properties, the cover having an overall thickness sufficient to substantially match the elevation of the surrounding pavement.

12. A manhole cover system in accordance with claim 11, wherein the cover is larger than the manhole lid.

13. A manhole cover system in accordance with claim 12, wherein the two bonded layers of rubber material comprise a bottom layer of recycled rubber material having a durometer of about 55-65, and a top layer of Neoprene rubber, having a durometer of about 55-65.

14. A manhole cover system in accordance with claim 11, wherein the cover is attachable to the top of the manhole lid by one of mechanical fasteners and chemical adhesive.

15. A manhole cover system in accordance with claim 11, wherein the two bonded layers of rubber material comprise a top layer, and further comprising indicia, associated with the top layer.

16. A manhole cover system in accordance with claim 15, wherein the indicia comprise integral rubber inlays of contrasting appearance in the top layer.

17. A rubber manhole cover, suitable for attaching to a top of a metal manhole lid, comprising:

at least two bonded layers of rubber material of differing properties, including a bottom layer of first rubber material, and a top layer of vulcanized rubber material, the top and bottom layers functioning as a single unit.

18. A manhole cover device in accordance with claim 17, wherein the bottom layer is of recycled rubber material having a durometer of about 55-65 and a thickness of from about ¼ to 2½ inches, and the top layer is of Neoprene rubber, having a durometer of from about 55-65 and a thickness of from about ¼ to ½ inch.

19. A manhole cover device in accordance with claim 17, further comprising a third layer of rubber material, affixed atop the top layer.

20. A manhole cover device in accordance with claim 17, further comprising indicia of rubber material integrally inlaid in the top layer.

* * * * *